US005601414A

United States Patent [19]

DiRe

[11] Patent Number: 5,601,414

[45] Date of Patent: Feb. 11, 1997

[54] INTERSTAGE LIQUID/GAS PHASE DETECTOR

[75] Inventor: John R. DiRe, Charlotte, N.C.

[73] Assignee: IMO Industries, Inc., Monroe, N.C.

[21] Appl. No.: 533,302

[22] Filed: Sep. 25, 1995

[51] Int. Cl.[6] ..... F04B 49/06

[52] U.S. Cl. ..... 417/44.2; 417/53; 418/2; 418/197

[58] Field of Search ..... 417/44.2, 53; 418/2, 418/197, 201.1

[56] References Cited

U.S. PATENT DOCUMENTS

| | | | |
|---|---|---|---|
| 3,574,488 | 4/1971 | VanderstegenDrake | 418/197 |
| 3,811,792 | 5/1974 | Kennedy, Jr. | 417/28 |
| 3,824,041 | 7/1974 | Rystrom | 417/310 |
| 4,225,290 | 9/1980 | Allington | 417/18 |
| 4,375,156 | 3/1983 | Shaw | 418/201.1 |
| 4,512,722 | 4/1985 | Mouton | 417/63 |
| 4,836,760 | 6/1989 | MacLeod | 418/166 |
| 5,292,234 | 3/1994 | Ling | 417/309 |
| 5,348,456 | 9/1994 | Kun et al. | 418/201.1 |

FOREIGN PATENT DOCUMENTS

| | | | |
|---|---|---|---|
| 506503 | 10/1954 | Canada | 417/44.2 |
| 293627 | 9/1991 | Germany | 418/197 |

*Primary Examiner*—Timothy Thorpe
*Assistant Examiner*—Xuan M. Thai
*Attorney, Agent, or Firm*—Hopgood, Calimafde, Kalil & Judlowe

[57] ABSTRACT

A positive displacement rotary axial screw pump which comprises a series of sealed closures formed by meshing of the rotors for building the internal pressure gradient of the pump from the pump inlet to its outlet. A programmable logic circuit is provided for signaling impending abnormal pressure conditions in the pump and, upon the onset of such conditions, modifying pump operation to compensate for the abnormal conditions. A pressure monitoring device detects selected disruption in the normal pressure gradient of the pump indicative of the impending abnormal conditions and signals the logic circuit of the impending conditions. The pressure monitoring device includes a pressure sensing device associated with at least one isolated volume for sensing internal pressure gradients of the pump.

14 Claims, 6 Drawing Sheets

INTERSTAGE LIQUID/GAS PHASE DETECTOR

BACKGROUND OF THE INVENTION

The invention relates generally to apparatus for monitoring operation of positive-displacement pumps and, more particularly, to a liquid/gas phase detector for multi-stage positive-displacement rotary axial-screw pumps.

In conventional pumps of this type, pressure is developed from the inlet or suction port of the pump to the outlet or discharge port in near-even stage-to-stage increments. Each stage is defined as a moving-thread closure or isolated volume formed by meshing of pump rotors between the inlet and outlet ends of the pump. Pressure is developed along the moving-thread closures as liquid progresses through the pump. The number of closures is usually proportional to the desired level of outlet pressure delivered, i.e., the greater the pressure, the greater the number of closures necessary. The closures enable the pump to develop an internal pressure gradient of progressively increasing pressure increments. Properly applied, a rotary axial-screw pump can be used to pump a broad range of fluids, from high-viscosity liquids to relatively light fuels or water/oil emulsions.

However, when large volumes of entrained or dissolved gas exit in solution within the pump, the normal progression of pressure gradient development is often disrupted, adversely affecting pump performance. If large quantities of gas become entrained in the pumped liquid, the internal pumping process may become unsteady and the internal pressure gradient can be lost. The pump may also vibrate excessively, leading to noise and excessive wear.

This condition is synonymous with a more common phenomena known as "cavitation". Cavitation usually occurs when the pressure of a fluid drops below its vapor pressure, allowing gas to escape from the fluid. When the pump exerts increasing pressure on a gaseous liquid, unstable stage pressures result leading to collapse of the gas bubbles in the delivery stage.

Traditional cavitation detection has been through audible noise, reduced flow rate, and increased pump vibration. However, by the onset of these occurrences, significant changes in pump operations may have occurred and it is often too late to protect the pump from internal damage. For example, where the pump is unable to develop a normal pressure gradient from suction to discharge, the total developed pressure may occur in the last closure. This upsets normal hydrodynamic support of the idler rotors, eventually leading to metal-to-metal contact with consequential damage to the pump.

Knowledgeable application and conservative ratings are traditional protection against these conditions. However, when pumping liquids with unpredictable characteristics or uncontrolled gas content, as is often the case, frequent monitoring of pump operations with attendant labor and other costs is required to maintain normal operations. Traditional means of detecting cavitation and other operating instabilities have been found particularly unsuitable where the pump is expected to give long reliable service at a remote unattended installation, and under extreme environmental conditions.

BRIEF STATEMENT OF THE INVENTION

It is therefore an object of the present invention to provide an improved apparatus and method for monitoring the operation of a multi-stage positive-displacement pump.

It is a specific object of the present invention to detect losses in the natural progression of the pressure gradient in such a pump, under normal operating conditions, so as to enable the pump to be used over a wider range of applications.

Another specific object of the present invention is to provide means for detecting potential cavitation not only before the pump has been damaged, but also with sufficient time for corrective measures to be taken.

Another objective of the present invention is to extend the range of pump operation during difficult applications, while minimizing the risk involved when selecting a pump for use in unfamiliar operating conditions.

A further object of the present invention is to meet the above objects using commercially available components with relatively little modification of an installed pump.

Still another object of the present invention is to provide means for detecting potential losses in the natural progression of the pressure gradient in a pump with sufficient time for corrective measures to be taken so as to prevent interruption of pump operation.

Yet another objective of the present invention is to effectively control the pumping process by monitoring the internal stage pressures, thereby preventing damage to the pump.

The invention meets these objects by using a programmable logic circuit to signal impending abnormal pressure conditions in the pump and, upon the onset of such conditions, modify pump operation to compensate for the abnormal conditions. A pressure monitoring device detects selected disruption in the normal pressure gradient of the pump indicative of the impending abnormal pressure conditions and signals the logic circuit. The pressure monitoring device may have a plurality of pressure sensing devices, each being associated with one of the isolated volumes, for sensing internal pressure gradients of the pump.

In accordance with one aspect of the present invention is a positive displacement pump which comprises:

- a series of isolated volumes for building the internal pressure gradient of the pump from the pump inlet to its outlet;
- a programmable logic circuit for signaling impending abnormal pressure conditions in the pump and, upon the onset of such conditions, modifying pump operation to compensate for the abnormal conditions;
- a pressure monitoring device for detecting selected disruption in the normal pressure gradient of the pump indicative of the impending abnormal conditions and signaling the logic circuit of the impending conditions,
- the pressure monitoring device having a pressure sensing device in at least one isolated volume for sensing internal pressure gradients of the pump.

In accordance with another aspect of the present invention is a system for protecting a positive displacement pump from operating damage, which comprises:

- a programmable logic circuit for signaling impending abnormal pressure conditions in the pump and, upon the onset of such conditions, modifying pump operation to compensate for the abnormal conditions; and
- a pressure monitoring device for detecting selected disruption in the normal pressure gradient of the pump indicative of the impending abnormal conditions and signaling the logic circuit of the impending conditions;
- the pressure monitoring device having a plurality of pressure sensing devices, each being associated with one of the isolated volumes, for sensing internal pressure gradients of the pump and signaling the gradients to the pressure monitoring device.

In accordance with a further aspect of the present invention is a process for protecting a positive displacement pump from operating damage, which comprises the steps of:

sensing internal pressure gradients of the pump using a pressure monitoring device, the device having a pressure sensing device associated with at least one in a series of volumes for determining the degradation or loss of pressure gradient of the pump from the pump inlet to its outlet;

signaling impending abnormal pressure conditions in the pump using a programmable logic circuit;

upon the onset of such conditions, modifying pump operation to compensate for the abnormal conditions;

detecting selected disruption in the normal pressure gradient of the pump indicative of the impending abnormal conditions, using the pressure monitoring device; and signaling the logic circuit of the impending conditions.

BRIEF DESCRIPTION OF THE DRAWINGS

The present invention will be described for the preferred embodiments, in conjunction with the accompanying drawings, in which.

The same numerals are used throughout the various figures to designate similar elements. Still other objects and advantages of the present invention will become apparent from the following description of the preferred embodiments.

DETAILED DESCRIPTION OF THE PREFERRED EMBODIMENTS

Figure 1:
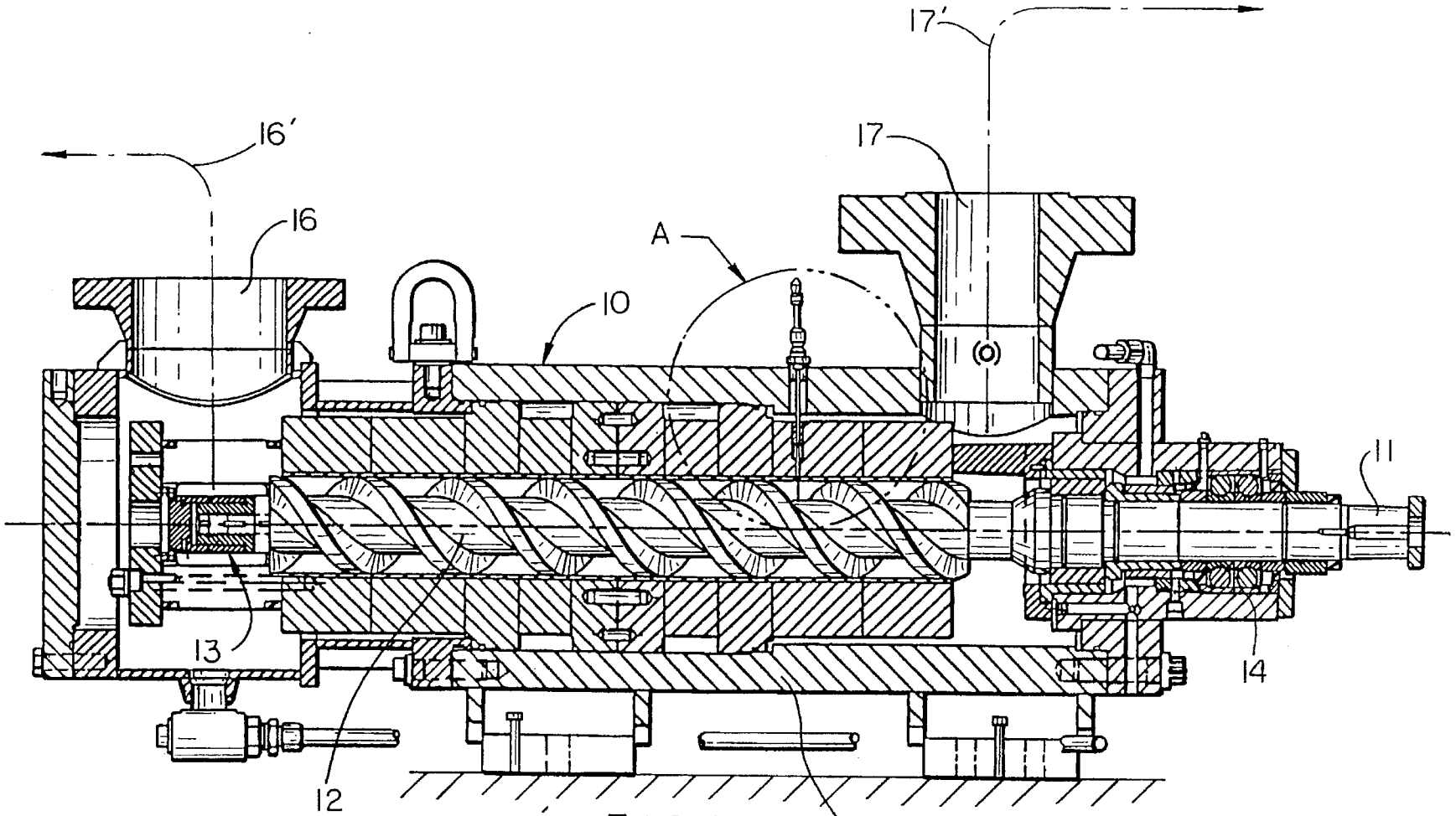
FIG. 1 is a simplified view of a multiple-stage rotary axial-screw pump, in vertical section along the central axis, to which the present invention is illustratively applicable.
Figure 2:
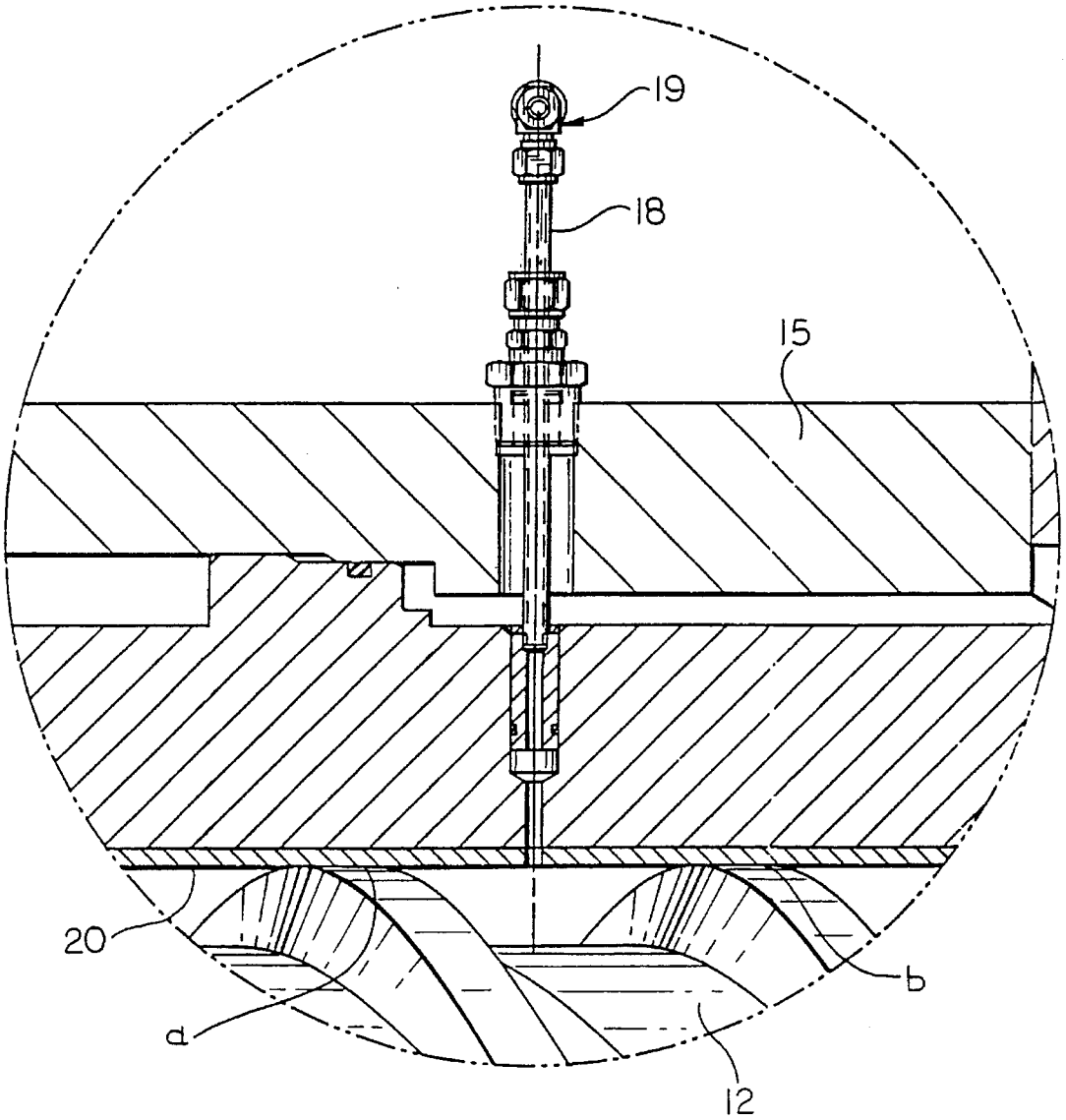
FIG. 2 is an enlarged fragmentary view of the section of FIG. 1 enclosed in phantom-circle.

The present invention relates generally to a positive displacement pump, e.g., a multi-stage rotary axial-screw pump 10, which comprises a series of isolated volumes for building the internal pressure gradient of the pump from the pump inlet to its outlet. A programmable logic controller 30 is used to signal impending abnormal pressure conditions in the pump and, upon the onset of such conditions, modify pump operation to compensate for the abnormal conditions. A pressure monitoring device 40 detects selected disruption in the normal pressure gradient of the pump, which may be indicative of the impending abnormal conditions, and signals the logic circuit of the impending conditions. The pressure monitoring device has a pressure sensing device 41 in at least one isolated volume of the pump for sensing the pump's internal pressure gradients.

Referring now to the drawings, and more particularly to FIGS. 1–6, there is shown generally a multi-stage rotary axial-screw pump 10, in accordance with one aspect of the present invention. In normal operation, this pump is driven continuously by a conventional motor 21, preferably connected to the exposed end 11 of a drive shaft for a horizontally elongate axially pumping rotor or drive screw 12. The drive screw is positioned by and runs within a bearing 14, all contained by a stationary liner 20 mounted in pump housing 15. The drive screw meshes with adjacent sealing rotors 26, 27 to form successive sealed stages or isolated volumes. An inlet port 16 is provided adjacent one end of the drive screw and an outlet port 17 is located at the opposite or discharge end of the screw. A check valve 24 is optionally located at the pump suction or inlet port 16.

Legends for an axis 16' of inlet flow and for an axis 17' of outlet flow suggest that pump 10 may be one of a distributed plurality of spaced pumps in a pipeline distribution system. The function of each pump, for example, is to make up for frictional losses in the pipeline along the way from a well-head or other source to the next pipeline section of pumped-oil delivery, as will be appreciated by those skilled in the art.

As shown in FIG. 1, legend "A" identifies a local region of general relevance to the present invention. The region includes a pressure-sensing tap or line 18 extending to a connector 19 which connects to pressure monitoring device 40, as set forth in greater detail in FIG. 2. This connection provides physically stabilized, tapped access to an intermediate-stage location along drive screw 12. An objective is to provide access from the axially advancing volume (between successive closures a,b of the screw thread of drive screw 12) to stationary liner 20 of the pump housing.

Figure 3A:
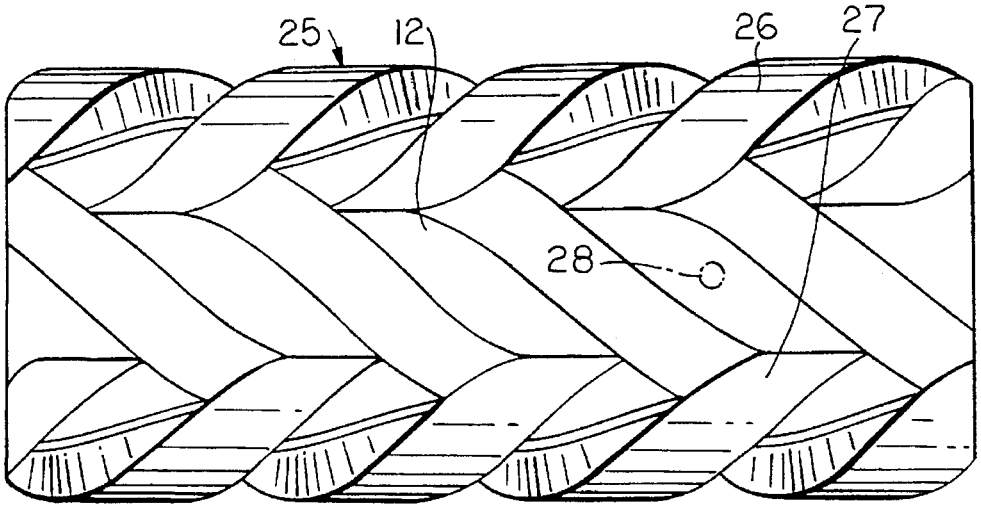
FIG. 3A is a simplified plan view of meshing elements of a rotary axial-screw pump, drawn to horizontally elongate scale between suction (inlet) and discharge (outlet) locations of pump action, in accordance with the present invention.

Shown in FIG. 3A is an illustrative three-closure axial-screw pump rotor set 25, with drive screw 12 meshing with sealing rotors 26, 27, in accordance with the present invention. Each of the three-closure volumes is bounded by (i) the respective meshing of successive turns of the drive-rotor thread with idler rotor threads, and (ii) successive pairs of drive-rotor thread running relationships to liner 20, as at a, b in FIG. 2. A dash-line circle 28 designates a preferred location for pressure sensing line 18 relative to the discharge end of the drive screw, and corresponds with the next-to-last closure boundary b of coaction between the rotor thread and the stationary liner. Alternatively, the pressure sensing line is located 180° from circle 28, or in both locations, i.e., at circle 28 and 180° from the circle.

Figure 3B:
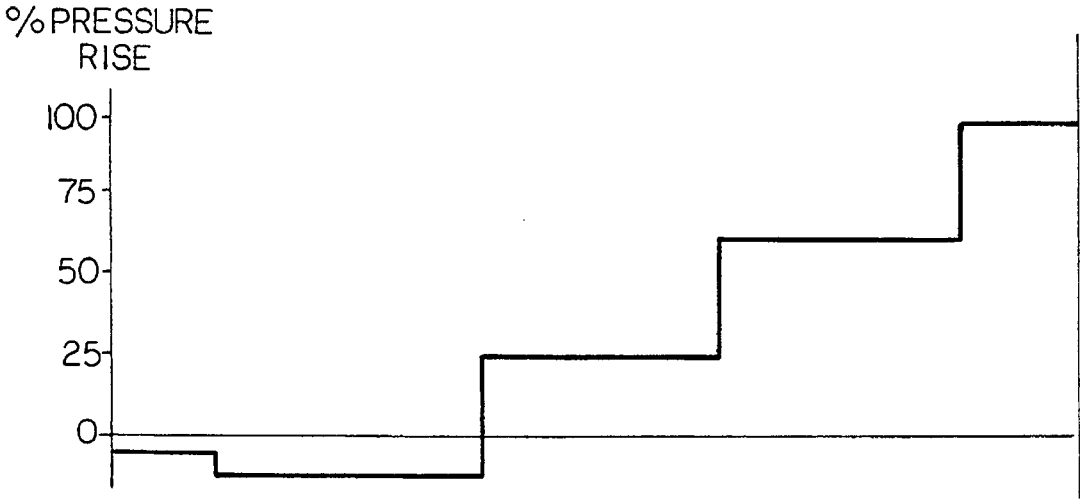
FIG. 3B is a plot, horizontally elongate to the same scale as FIG. 3A, to show illustrative stage pressures for normal, i.e., satisfactory, operation of the meshing elements of FIG. 3A.

Provided in FIG. 3B is the relationship between % pressure rise vs. displacement along the rotor shaft for the three-closure pump of FIG. 3A. As shown, the gradient established by successive stages or closure volumes is in uniform incremental steps. This illustrates the development of a normal or desirable pressure-gradient along the threaded length of rotor set 25.

Figure 3C:
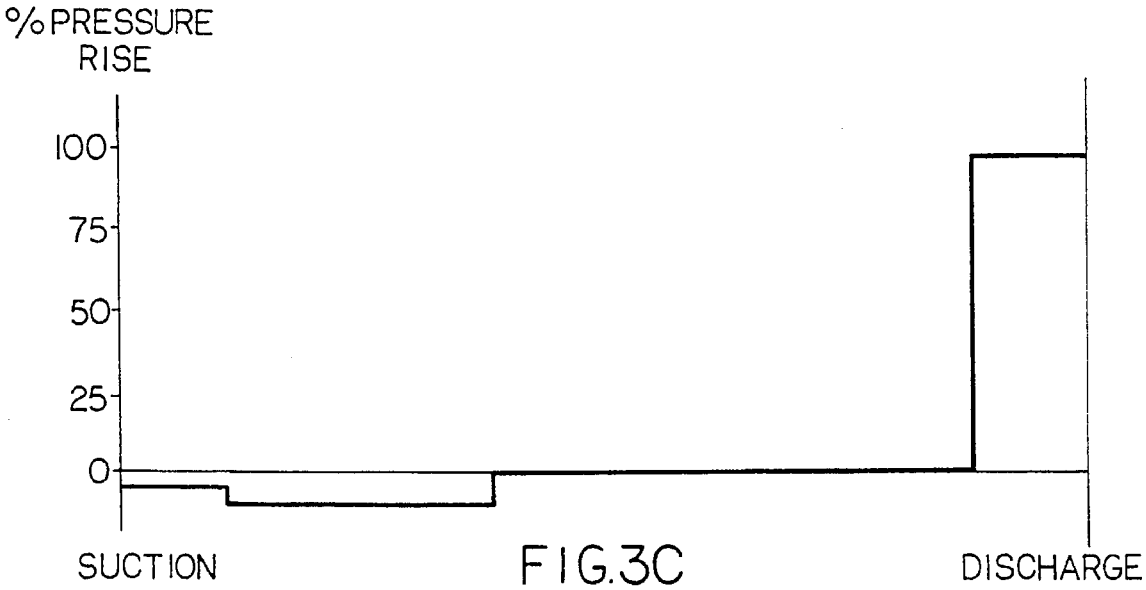
FIG. 3C is another plot, similar to that of FIG. 3B and to the same horizontally elongate scale, which shows a breakdown in the resulting stage pressure, the total static head being developed in the last closure.

In contrast is the pressure-gradient profile shown in FIG. 3C. FIG. 3C, which is to the same horizontal scale as FIGS. 3A and 3B, illustrates unsatisfactory, nonuniform operation of the meshing elements, i.e., during cavitation, or while pumping liquids having a relatively high percentage of gas.

Figure 4A:
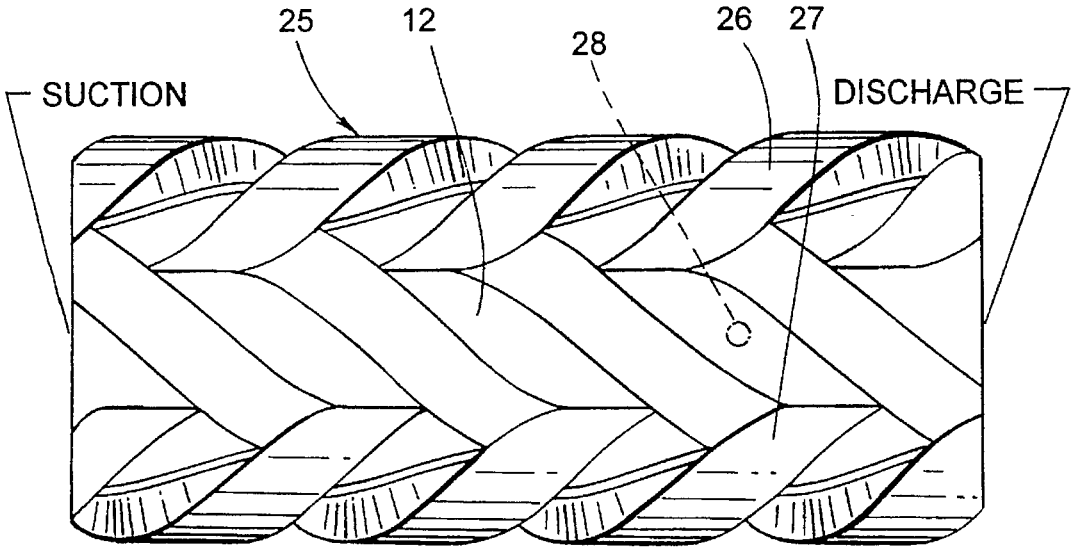
FIG. 4A is a simplified plan view of meshing elements of a rotary axial-screw pump, drawn to a horizontally elongate scale between suction (inlet) and discharge (outlet) locations of pump action, in accordance with another aspect of the present invention.
Figure 4B:
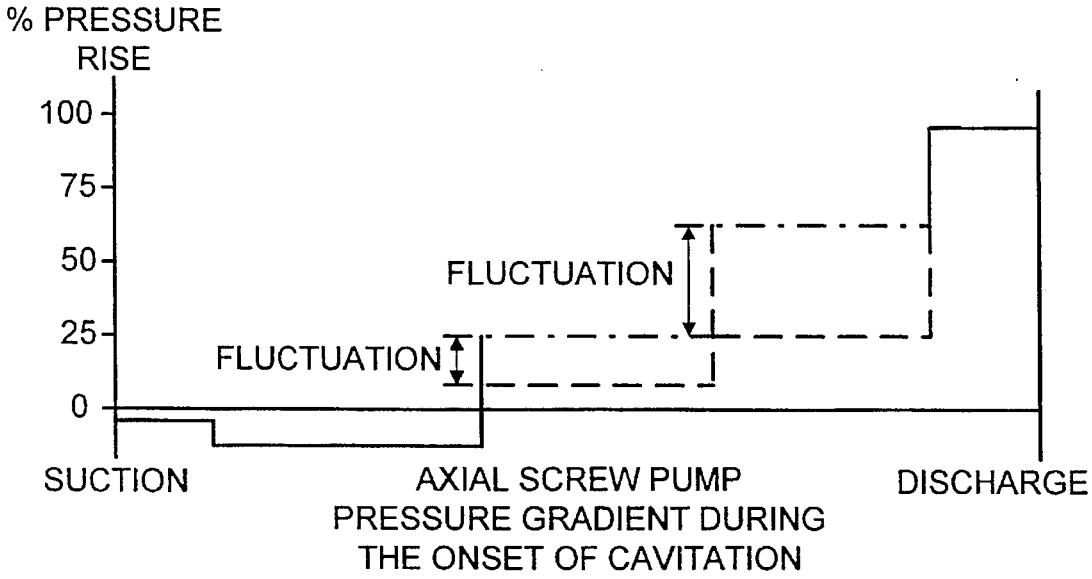
FIG. 4B is a plot, horizontally elongate to the same scale as FIG. 4A, to show illustrative stage operating pressures of the meshing elements of FIG. 3A during the onset of unsteady operation of the same meshing elements.

FIGS. 4A and 4B, respectively, show a pump 10 and its internal pressure gradient during the onset of cavitation. As set forth in FIG. 4B, pressure in the intermediate pump stages fluctuates during the onset of cavitation, building to a relatively high level, then falling to a lower level. Fluctuation continues until suction conditions worsen and total loss of stage pressure or full cavitation results. This condition is illustrated in FIG. 3C.

The present invention advantageously detects conditions which can lead to the onset of cavitation, and makes appropriate pressure adjustments before pressure fluctuations may occur. The invention is also beneficial in preventing such conditions long before there has been destruction or distortion of the pressure gradient.

To accomplish this task, each pressure-sensing device or sensor 41, in accordance with one aspect of the present invention, first detects the degradation of internal-closure pressure within the pump, then sends an output signal to activate programmable logic controller 30, e.g., a conventional or nonconventional programmable logic circuit. Preferably, at least one pressure-sensing device is installed in the pump, e.g., in an isolated volume at an intermediate pump stage. Upon detecting an intermediate-stage pressure below a predetermined tolerable threshold, the logic controller is activated and takes certain control measures, such as sounding an alarm or a horn signal to the operator, and/or effecting automatic shutdown of the pump.

Figure 5:
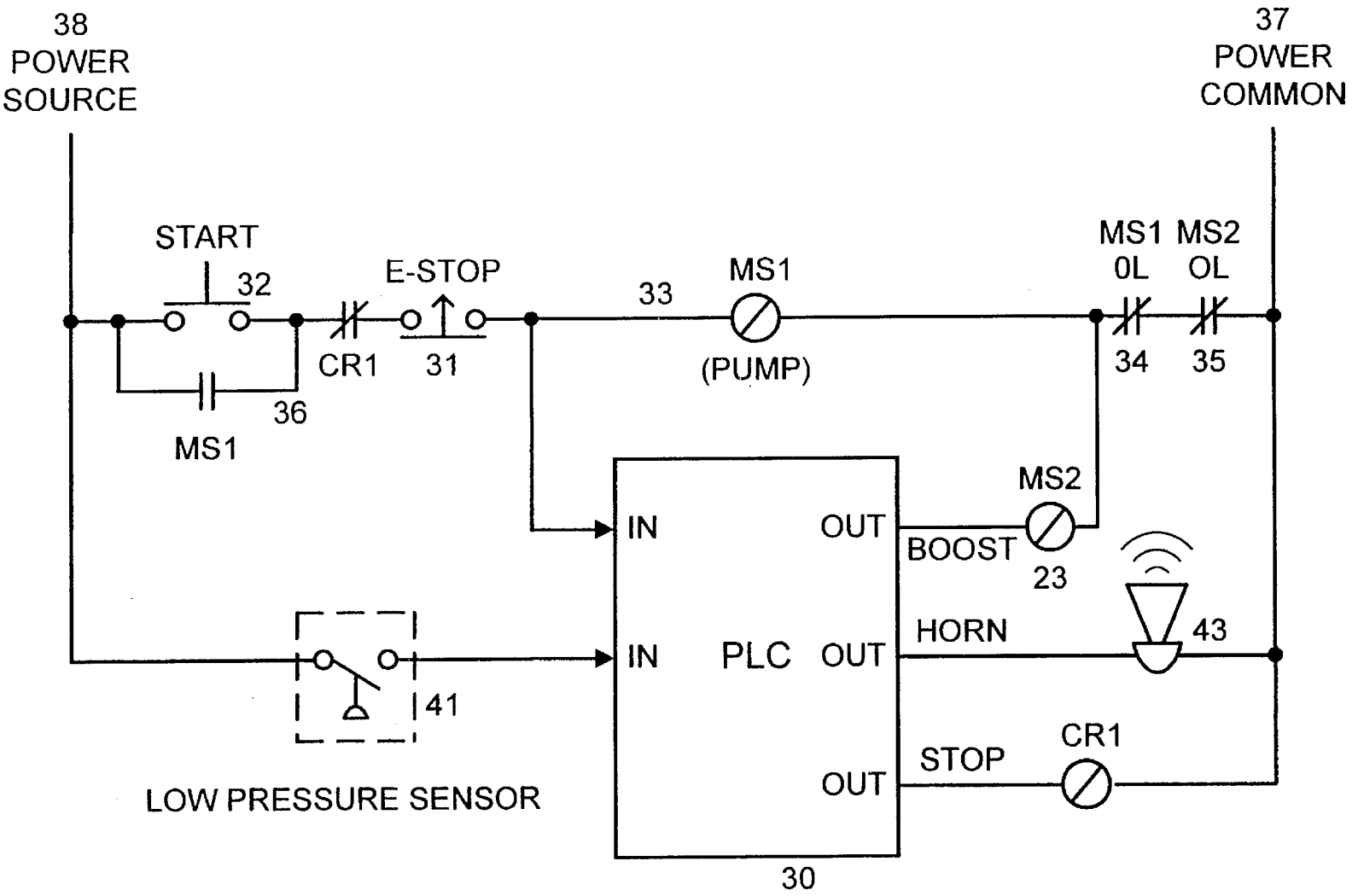
FIG. 5 is an electrical control circuit diagram for operation of the pump of FIGS. 1 and 2, in accordance with one aspect of the present invention.
Figure 6:
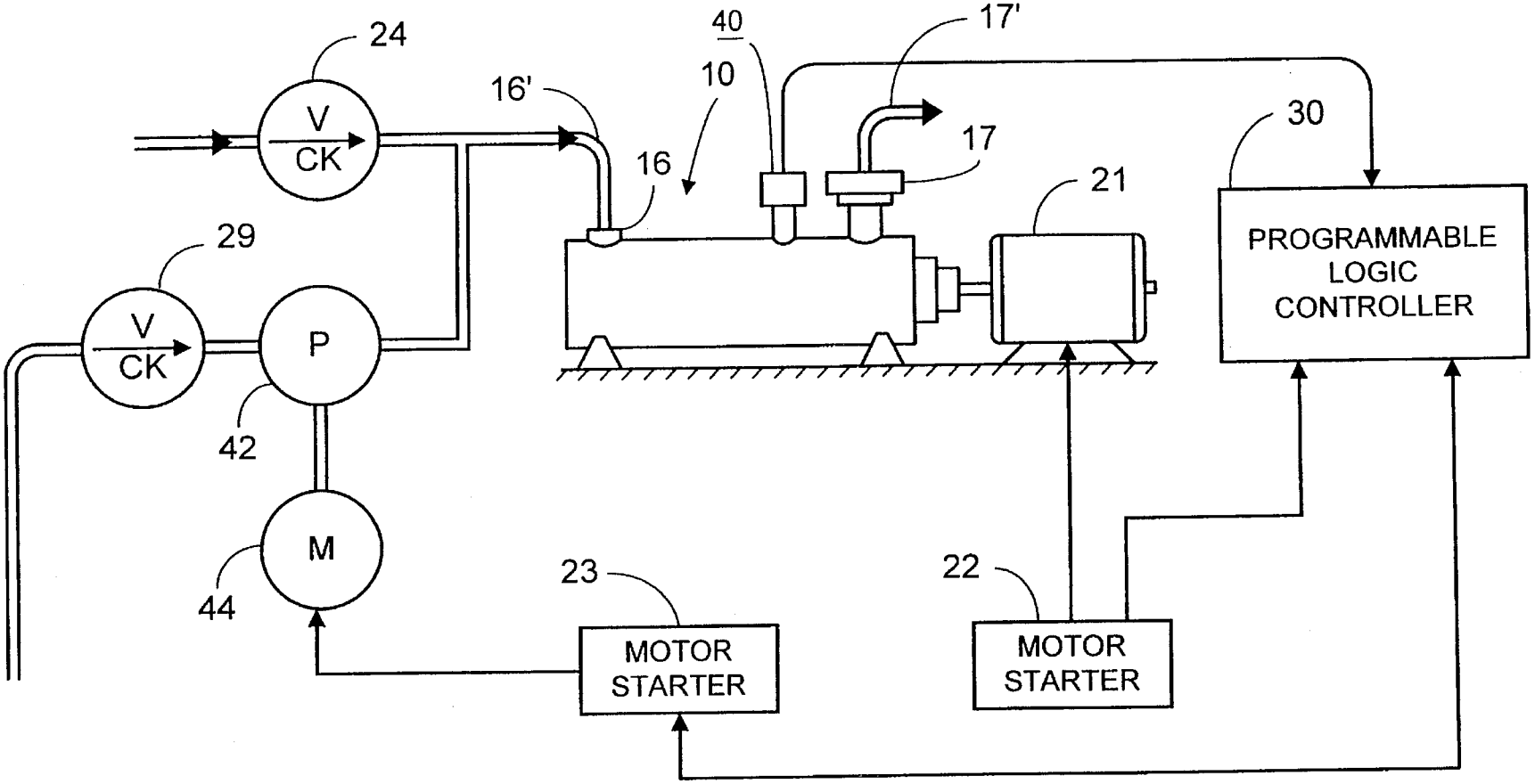
FIG. 6 is a hydraulic schematic diagram for components operated by the control circuit of FIG. 5.

Preferably, however, and particularly if the axial-screw pump operates at an unmanned station, the controller is programmed to automatically activate a booster pump 42, as shown in FIGS. 5 and 6, to assure a driven flow of booster-pumped liquid to inlet 16 of the axial-screw pump. Programming of the logic controller may be accomplished by conventional methods, as will be appreciated by those skilled in the art.

When abnormal pressure conditions, e.g., a low suction pressure, are detected by sensor 41, the programmable logic controller causes an alarm or horn 43 to sound and corrects the pressure condition, e.g., by initiating booster pump 42. Booster pump operation then continues until stage-pressure monitoring indicates that an acceptable pressure level has been restored, at which point the controller shuts down the booster pump.

If the booster pump fails to restore the axial-screw pump to satisfactory operation within a selected time, the logic controller shuts down both the axial-screw pump and the booster pump. This is preferably accompanied by automatic indication and/or remote transmission of the reason for the shut down. When pressure conditions are later restored, e.g., to a normal level, the logic controller resumes pumping operations.

Alternatively or concurrently therewith, when deficiencies in the pressure gradient are detected, the logic controller slows pump operation, then activates conventional gas separators (not shown) along the line, e.g., near the pumping station, to effect gas removal.

Although the present invention is shown and described as having a pressure sensing device in at least one isolated volume, it is understood that any suitable combination of one or more pressure sensing devices with isolated volumes could be utilized, giving consideration to the purpose for which the present invention is intended. For example, a pressure sensing device may be used in the first isolated volume at the beginning of the pump, and in the last isolated volume at the end of the pump. Alternatively, a pressure sensing device is located in each isolated volume. In another alternative embodiment, two or more pressure sensing devices are used in at least one isolated volume, e.g., in the middle isolated volume. In still another alternative scenario, at least one pressure sensing device is provided in each of the one or more isolated volumes.

To complete installation, other features may be provided, including an MSI relay coil 33, power overload protection OL 34, 35, an MSI-1 contact 36 with start function 32, a power common or AC COM 37 and an emergency stop function 31. The programmable logic controller is preferably provided with at least a 120 VAC power supply 38.

A hydraulic circuit diagram for components operated by the control circuit of FIG. 5 is shown in FIG. 6. Motor 21 which operates pump 10 is selectively activated by the programmable logic controller via motor starter or relay 22. Actuation of booster pump 42 operated by motor 44 is achieved by another motor starter or relay 23. This connection allows the logic controller to monitor the intake pressure and, when this pressure falls below a predetermined threshold value, activates the booster pump, thereby facilitating pump operation. The additional flow provided by the booster pump is directed to inlet stream 16' via a check valve 29.

Although the present invention, as shown and described, effects system shutdown (or sounds an alarm) upon detection of undesirable pressure conditions, the logic controller may be programmed with other "SMART" functions for extending the operating range of a positive-displacement type pump, within the spirit and scope of the present invention. In addition, while the invention is illustrated with reference to positive-displacement rotary axial-screw type pumps having multiple stages, its application to other positive-displacement pumps, e.g., gear pumps, is understood, giving consideration to the purpose for which the invention is intended.

Since from the foregoing the construction and advantages of the invention may be readily understood, further explanation is believed unnecessary for purposes of illustrating the present invention. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. A positive displacement pump which comprises:

a series of isolated volumes for building the internal pressure gradient of the pump from the pump inlet to its outlet;

a programmable logic circuit for signaling impending abnormal pressure conditions in the pump and, upon the onset of such conditions, modifying pump operation to compensate for the abnormal conditions; and a pressure monitoring device for detecting selected disruption in the normal pressure gradient of the pump indicative of the impending abnormal conditions and signaling the logic circuit of the impending conditions, the pressure monitoring device having a pressure sensing device in at least one isolated volume for sensing internal pressure gradients of the pump.

2. The pump set forth in claim 1 wherein modification of pump operations to compensate for the abnormal pressure conditions includes cessation of pump operations.

3. The pump set forth in claim 1 wherein the programmable logic circuit signals erratic pressure conditions in the pump.

4. The pump set forth in claim 1 wherein the programmable logic circuit is activated upon substantial decreases in stage pressure in the pump.

5. The positive displacement pump set forth in claim 1 being a rotary axial screw pump.

6. The positive displacement pump set forth in claim 1 being a gear pump.

7. The positive displacement pump set forth in claim 5 wherein each isolated volume is formed by meshing of the rotors and defines a sealed closure.

8. A positive displacement rotary axial screw pump which comprises:

a series of sealed closures defined by isolated volumes formed by meshing of the rotors, for building the internal pressure gradient of the pump from the pump inlet to its outlet;

a programmable logic circuit for signaling impending abnormal pressure conditions in the pump and, upon the onset of such conditions, modifying pump operation to compensate for the abnormal conditions; and a pressure monitoring device for detecting selected disruption in the normal pressure gradient of the pump indicative of the impending abnormal conditions and signaling the logic circuit of the impending conditions, the pressure monitoring device having at least one pressure sensing device in an isolated volume for sensing internal pressure gradients of the pump.

9. The pump set forth in claim 8 wherein modification of pump operations to compensate for the abnormal pressure conditions includes shut-down of pump operations.

10. The pump set forth in claim 8 wherein the programmable logic circuit signals erratic pressure conditions in the pump.

11. The pump set forth in claim 8 wherein the programmable logic circuit is activated upon substantial decrease in stage pressure in the pump.

12. A system for protecting a positive displacement pump from operating damage, which comprises: and a programmable logic circuit for signaling impending abnormal pressure conditions in the pump and, upon the onset of such conditions, modifying pump operation to compensate for the abnormal conditions; and a pressure monitoring device for detecting selected disruption in the normal pressure gradient of the pump indicative of the impending abnormal conditions and signaling the logic circuit of the impending conditions;

the pressure monitoring device having a plurality of pressure sensing devices, each being associated with one of the isolated volumes, for sensing internal pressure gradients of the pump and signaling the gradients to the pressure monitoring device.

13. A positive displacement pump which comprises:

a series of isolated volumes for building the internal pressure gradient of the pump from the pump inlet to its outlet;

a programmable logic circuit for signaling impending abnormal pressure conditions in the pump and, upon the onset of such conditions, modifying pump operation to compensate for the abnormal conditions; and a pressure monitoring device for detecting selected disruption in the normal pressure gradient of the pump indicative of the impending abnormal conditions and signaling the logic circuit of the impending conditions, the pressure monitoring device having a pressure sensing device in at least one isolated volume for sensing internal pressure gradients of the pump.

14. A process for protecting a positive displacement pump from operating damage, which comprises the steps of:

sensing internal pressure gradients of the pump using a pressure monitoring device, the device having a pressure sensing device associated with at least one in a series of volumes for determining the degradation or loss of pressure gradient of the pump from the pump inlet to its outlet;

signaling impending abnormal pressure conditions in the pump using a programmable logic circuit;

upon the onset of such conditions, modifying pump operation to compensate for the abnormal conditions;

detecting selected disruption in the normal pressure gradient of the pump indicative of the impending abnormal conditions, using the pressure monitoring device; and signaling the logic circuit of the impending conditions.

* * * * *